United States Patent [19]

James

[11] 4,177,528

[45] Dec. 11, 1979

[54] SANITARY CHAIRS

[76] Inventor: David R. James, Covertside, Hasfield, Gloucester, England

[21] Appl. No.: 648,775

[22] Filed: Jan. 13, 1976

[30] Foreign Application Priority Data

Jan. 21, 1975 [GB] United Kingdom ..... 2538/75

[51] Int. Cl.[2] ..... A47K 11/04; B60N 1/06; B60R 21/10

[52] U.S. Cl. ..... 4/134; 4/254; 297/417; 297/466

[58] Field of Search ..... 4/134, 185 R, 185 S, 4/185 L, 185 B, 185 AB, 251, 254; 297/417, 390

[56] References Cited

U.S. PATENT DOCUMENTS

| | | | |
|---|---|---|---|
| 3,512,187 | 5/1970 | Thomas et al. | 4/254 X |
| 3,531,158 | 9/1970 | Allen | 297/390 |
| 3,769,638 | 11/1973 | Clanan | 4/134 |
| 3,829,916 | 8/1974 | James | 4/185 L |
| 3,931,650 | 1/1976 | Miller | 4/134 |

FOREIGN PATENT DOCUMENTS

| | | | |
|---|---|---|---|
| 1307758 | 9/1962 | France | 297/390 |
| 1338252 | 8/1963 | France | 297/390 |
| 1547073 | 10/1968 | France | 297/390 |

*Primary Examiner*—Stuart S. Levy
*Attorney, Agent, or Firm*—Cushman, Darby & Cushman

[57] ABSTRACT

A sanitary or commode chair has a wheeled chassis and an apertured seat adapted to be positioned over a W.C. The chair has side support arms which extend alongside a user seated in the chair. Each arm has an inturned end portion to provide front support for the user, and the end portions of the arms can be turned outwardly to the side to allow front entry and exit. Each support arm can also pivot rearwardly and to the side to allow side entry from a wheelchair.

7 Claims, 3 Drawing Figures

SANITARY CHAIRS

FIELD OF THE INVENTION

This invention relates to sanitary chairs, i.e. to chairs with an apertured seat adapted to be positioned over a W.C. pedestal for toiletting purposes, and to commode chairs.

BACKGROUND OF THE INVENTION

Sanitary and commode chairs are most commonly used by the elderly and infirm who frequently require supporting while in a seated position. Such chairs are accordingly usually provided with side support arms, but there is always the danger of a user falling forwards off the seat. The object of the invention is to provide a chair construction which guards against this eventuality.

SUMMARY OF THE INVENTION

According to the invention a sanitary or commode chair has side support arms which extend alongside and are inturned in front of a person seated in the chair, the inturned end portions of the arms being capable of opening movement relative to main side portions of the arms to allow front entry and exit for the user.

Preferably the end portion of each arm pivots, upwardly and to the side, about the longitudinal axis of the main side portion of the arm to provide said opening movement. Each arm may also pivot rearwardly and to the side as a whole, preferably about a more or less vertical axis, so as to enable a user to be slid on to the seat from the side, for example from a wheelchair. This is a facility which is particularly valuable with elderly and infirm patients who have to be placed in position on the chair.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
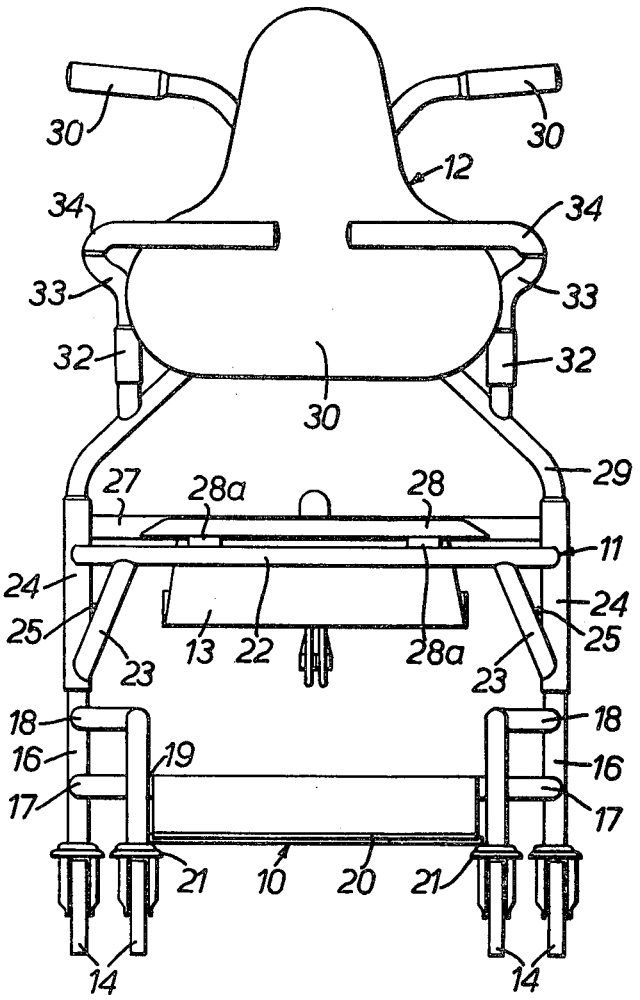
FIG. 1 is a front view of a sanitary chair in accordance with the invention.

The chair has a tubular frame construction, and comprises a mobile chassis base frame portion 10 and a seat portion 11 integral with a backrest portion 12. The drawings show a toilet pan which clips on below the seat portion 11 for use as a commode chair, the pan 13 not being fitted when the chair is used for its more usual toilet function in conjunction with a W.C.

The chassis frame portion 10 is open at the rear so that the chair can be wheeled backwards over a W.C. pan, and it has four corner castors 14. The front castors have brakes 15 which can be applied to immobilise the chair when in position. Vertical rear corner members 16 have the rear castors 14 fitted to them, and the portion

10 further comprises spaced parallel side members 17 and 18 at each side interconnected by a cross member 19 towards the front of the chassis. The upper side members 18 are bent downwardly at the front to provide vertical end portions to which the front castors 14 are fitted.

Figure 3:
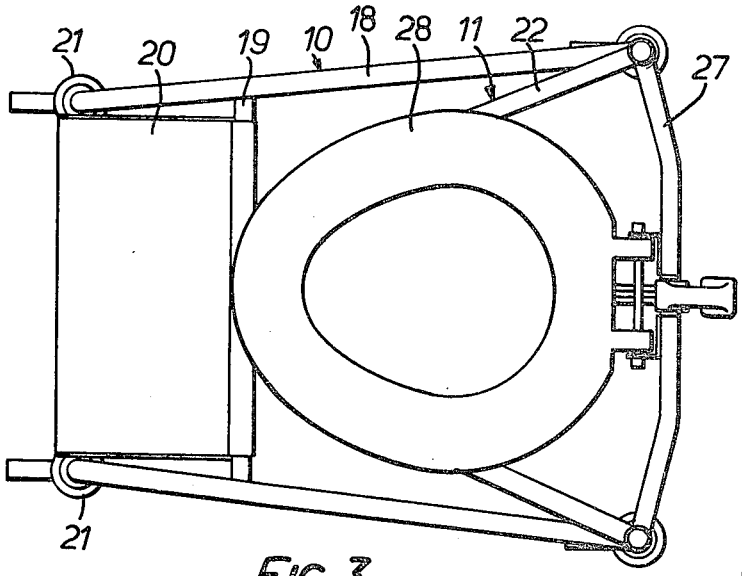
FIG. 3 is a plan view on the line III—III in FIG. 2.
Figure 2:
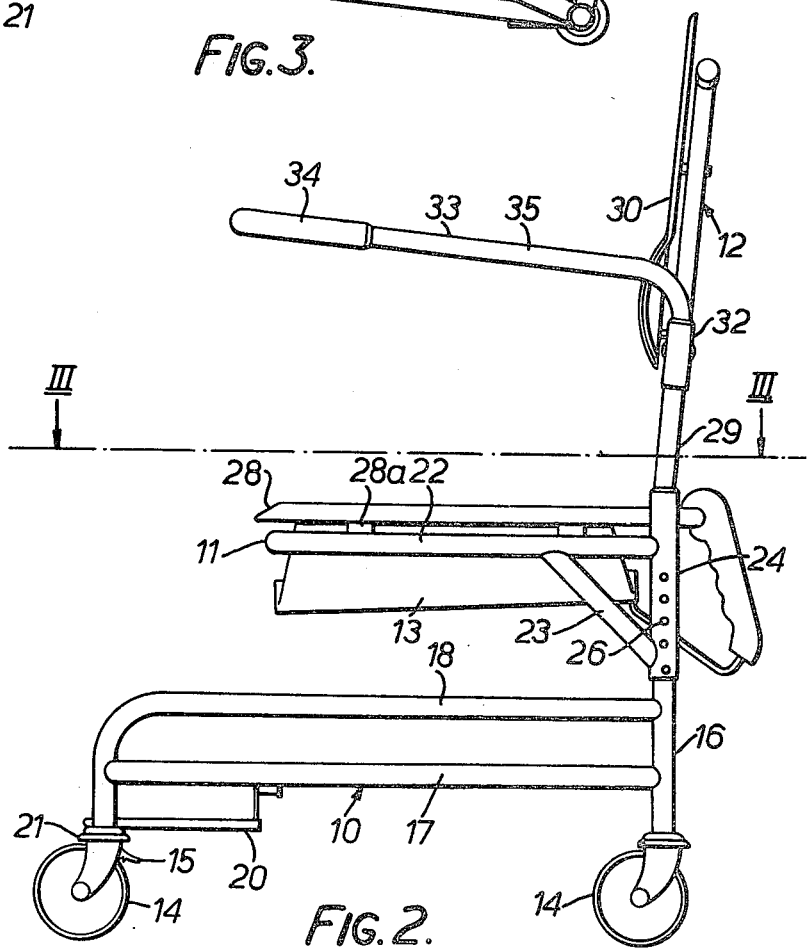
FIG. 2 is a side view thereof.

As can be seen from FIGS. 1 and 3 the side members 17 and 18 at the two sides of the chassis are mutually inclined, to provide in plan view a generally trapezium shape narrower at the front. Thus the chair fits into the rear of a similar chair, and hence a plurality of chairs can be stacked in a small space in nesting relationship, one fitting into the rear of another.

A footrest 20 of the chassis portion 10 is hinged on the front cross member 19 and, in the operative down position shown, rests on the mountings 21 of the front castors 14.

The seat portion 11 comprises a seat support frame member 22 which is generally V-shaped and disposed in a horizontal plane. It has short rear support struts 23 but is mainly cantilevered from corner rear support legs 24. These legs 24 telescopically engage the chassis corner members 16 for the purpose of heightwise adjustment of the seat portion 10. The adjustment is set, once made to suit the height of a particular W.C. pedestal, by means of pins 25 inserted through registering holes in the legs 24 and chassis members 16, the latter forming stubs engaging the legs 24.

A cross member 27 interconnects the support legs 24 and to this a moulded toilet seat 28 is rearwardly hinged. The seat 28 is similar to a normal W.C. toilet seat and has lower support pads **28*a* by which it rests on the frame member 22, when in the down position. The cross member 27 is above the frame member 22 so that it does not impede nesting of two chairs, before which the seat 28** of the rear chair is hinged up out of the way.

The back portion 13 comprises two side frame members 29 which extend upwardly from the legs 24 and are mutually inclined inwardly to provide back support for a moulded backrest 30. At a suitable level the members 29 are out-turned to provide hand grips 31 by which the chair can be propelled. Welded to each of the side members 29 is a pivotal mounting 32 for an armrest 33.

Each armrest 33 can pivot as a whole, to one side and about a generally vertical but slightly rearwardly inclined axis in the corresponding mounting 32, out of the way to enable an elderly user to be slid on to the seat 28 from that side. Inturned end portions 34 of the armrests provide front support for the user, which is especially valuable with the elderly and infirm. The armrests 33 are self-locking in position, having to be lifted slightly before they can be turned to the side in the mountings 32.

When side access is not required, the end portions 34 can be turned upwardly and outwardly on their own on the main side members 35 of the armrests 33. Thus they can be turned out of the way, about more or less horizontal axes aligned with the side members 35, to a laterally out-turned position which allow front access to the chair between the armrests 33. The end portions 34 turn freely through about 180° between the laterally inturned front support position shown and the laterally out-turned front entry position. In the latter position they can provide a hand grip and support to assist a disabled user when entering or leaving the chair.

I claim:

1. A sanitary or commode chair having an apertured seat and two side support arms each of which comprises a main side portion arranged to extend alongside, and an inturned end portion arranged to extend in front of, a person seated in the chair, and means movably mounting the end arm portions on the main side portions for opening movement relative to the side portions of the arms whereby to allow front entry and exit of the user with the side portions in the normal side-support position.

2. A chair according to claim 1, wherein each said mounting means enables the end portion of the corresponding arm to pivot upwardly and to the side, about the longitudinal axis of the main side portion of the arm to provide said opening movement.

3. A chair according to claim 2, wherein the arrangement is such that each arm end portion pivots between a laterally inturned front support position and a laterally outturned front entry position, whereby when in the entry position the end portions are adapted to provide support to assist a user when entering or leaving the chair.

4. A chair according to claim 1, wherein each arm is supported by a pivot mounting such that the arm can pivot rearwardly and to the side as a whole.

5. A chair according to claim 4, wherein the pivot axis for each arm as a whole is more or less vertical.

6. A chair according to claim 4, wherein the side arms are self-locking with said main portions in said normal side-support position.

7. A chair according to claim 6, wherein locking means associated with said arm pivot mountings can be freed, by lifting each side arm slightly, to allow the arms to be turned about the arm pivot axes.

* * * * *